US005193226A

United States Patent [19]

Mortenson

[11] Patent Number: 5,193,226

[45] Date of Patent: Mar. 16, 1993

[54] FACE MASK AND EARPLUG CASE

[76] Inventor: Steven C. Mortenson, Box 15, Charlestown, N.H. 03603

[21] Appl. No.: 787,512

[22] Filed: Nov. 4, 1991

[51] Int. Cl.[5] ..... A42B 1/24

[52] U.S. Cl. ..... 2/422; 2/185 R; 2/199

[58] Field of Search ..... 2/422, 185 R, 199; 206/461, 470, 471, 457, 458; 224/181, 182, 269, 271

[56] References Cited

U.S. PATENT DOCUMENTS

| | | | |
|---|---|---|---|
| 3,546,709 | 7/1968 | Cross | 2/179 |
| 3,765,031 | 10/1973 | Beresic | 2/185 R |
| 3,813,016 | 5/1974 | Bohannan | 2/199 |
| 4,002,895 | 1/1977 | Ketler et al. | 240/60 |
| 4,274,157 | 6/1981 | Boden | 2/181.4 |
| 4,312,076 | 1/1982 | Gamm | 2/199 |
| 4,316,289 | 2/1982 | Hild | 2/191 |
| 4,397,044 | 8/1983 | Trepanier | 2/4 |
| 4,451,935 | 6/1984 | Henschel | 2/199 |
| 4,633,530 | 1/1987 | Satterfield | 2/423 |
| 4,686,712 | 8/1987 | Spiva | 2/10 |
| 4,781,451 | 11/1988 | McAllen | 351/156 |
| 4,796,380 | 1/1989 | Beese | 43/57.1 |
| 5,070,546 | 12/1991 | Stazo et al. | 2/199 |

*Primary Examiner*—Peter Nerbun
*Assistant Examiner*—Michael A. Neas
*Attorney, Agent, or Firm*—Michael J. Weins

[57] ABSTRACT

The present invention is for a face mask/earplugs case designed for on-site use by construction workers. Both face masks and earplugs are needed on an intermittent basis by construction workers when on site. The face mask/earplugs case of the present invention is attachable to a piece of clothing, thereby providing accessible storage of the face masks and earplugs when not needed. In one preferred embodiment, the case attaches to a helmet and is configured to substantially conform to the footprint of the helmet, thereby not obstructing or limiting the mobility of the wearer.

16 Claims, 6 Drawing Sheets

FACE MASK AND EARPLUG CASE

FIELD OF THE INVENTION

This invention relates to an in-field storage case for carrying face masks and earplugs and, more particularly, to a case for attaching to clothing. In one particular embodiment the invention employs protection head gear, such as a helmet or a hard hat, as a clothing element to which the case mounts. In the case of head protective gear, provisions can be made for providing a second case for storing safety glasses.

BACKGROUND OF THE INVENTION

In today's safety conscious world there is an increased concern for the protection and well being of the work force. This concern has gone beyond the plant work site and is now being carried into the field. The construction industry is now subject to the OSHA rules and regulations. Section 1926 of the code sets forth, in detail, many of the safety requirements. This code requires that, on construction sites where the working conditions demand, workers be provided with respiratory equipment, earplugs and eye protection, in addition to hard hats, and it requires that workers use such equipment when needed.

On many construction sites, use of head protection is required at all times. Although head gear is the rule for many construction sites, on site conditions are often such that only intermittent protection for the eyes, ears, and respiratory tract is needed.

In fact, in some instances the untimely use of eye, ear and respiratory protection can create a hazard. Ear protection, which may save the worker's hearing from damage caused by the noise of a jackhammer, may also prevent the worker from hearing an approaching vehicle. Protective face masks can limit the sense of smell and delay awareness of smoke.

Furthermore, eye, ear and respiratory protection frequently are worn at the cost of the user's comfort. Thus, there is a need for protective eye, ear, and respiratory equipment which can be easily carried with the worker on the site and conveniently accessed as a need to use the equipment arises.

Cords have been attached to glasses so that they can be intermittently worn; however, the cord leaves the glasses dangling, creating a safety hazard, as the glasses and cord may become entangled. Furthermore, the glasses may be scratched or crushed when left hanging from a cord. The problem of storing protective equipment when not in use has in part been overcome for eye and ear protective equipment by attaching this protective equipment to a helmet in such a way that it can be swung into position over the eyes and ears when protection is required. The pivotably mounted protective eye and ear equipment substantially increases the cost of the helmet and can protrude from the helmet to such an extent as to make working in close quarters more difficult.

Thus, there is a need for a storage system for the eye, ear, and respiratory protective equipment which can be conveniently stored by a worker for intermittent use and is accessible upon demand.

SUMMARY OF THE INVENTION

It is an object of the present invention to provide a case for storage of multiple dust masks and for earplugs which can readily be attached to the clothing of an individual and can be easily accessed by the individual.

Still another object of the invention is to provide cases for a helmet which serve in combination with the helmet as a storage system for protective equipment needed on the work site.

It is still a further object of the invention to provide a visual notice when the cases for storing protective equipment are not attached to the element of clothing of the worker.

These and other objects of the present invention will become apparent from the following description, drawings, and claims.

The present invention in its simplest form is a case for carrying face masks and earplugs, which are needed on an intermittent basis by construction workers on site. The case is designed to be used for fabric face masks for removing dust or other particulate material from the air inhaled by the wearer. Such masks are sold by 3M, Pro Guard, and Gerson. These face masks are used to protect the wearer from non-toxic particles. The masks have an outer convex side and an inner concave side, the latter of which fits over the nose and mouth of the wearer. The masks are held in position by an elastic strap.

The case of the present invention has a first shell having a first shell upper surface and a first shell lower surface with the first shell lower surface having a cavity therein. The cavity is configured to substantially conform to the convex side of the dust mask. A first shell rim is attached to the first shell.

A second shell has a second shell upper surface and a second shell lower surface. The second shell has a compartment therein with a passage providing access to the compartment. The second shell upper surface has a convex protrusion thereon. The protrusion is so configured to substantially conform to the cavity in the first shell. It is further preferred that a door be provided to close the passage to the compartment in the second shell.

A second shell rim is attached to the second shell. When the first shell rim and the second shell rim are in contact, the first shell and the second shell are in close proximity, however the portion of the first shell bounding the cavity therein is spaced apart from the protrusion on the second shell. This spacial separation provides a mask storage region between the first shell and the second shell.

It is further preferred that passage to the compartment in the second shell be in the upper surface of the second shell. Having the passage so positioned ensures that this compartment will remain dust and moisture free when the shell rims are engaged.

Means for attaching the first shell rim to the second shell rim are provided. It is further preferred that the means for connecting the first shell rim to the second shell rim be an engaging pair of corners formed by sidewalls and ledges. A first rim corner, which is contained in the first shell rim, has a first corner sidewall and a bottom ledge. A second rim corner, which is contained in the second shell rim, has a second corner sidewall and a top ledge. The corners are preferably configured such that when they mate the first corner sidewall slidably engages the second corner sidewall and the bottom ledge is in intimate contact with the top ledge when the rims are engaged. Having the corners so mate provides a seal between the two rims, thereby preventing moisture and dust from contaminating masks stored in the case.

In one preferred embodiment a hinge means is provided which attaches to the first shell rim and to the second shell rim. With the two shell rims attached to the hinge, the first shell pivotably moves with respect to the second shell.

Means for fastening the case to an element of outer clothing such as a helmet or belt are provided. These means for fastening the case are attached to the second shell lower surface.

It is further preferred that the means for fastening the case to an element of clothing be selected from the group of fasteners comprised of magnetic fasteners and hook and pile fasteners. It is also preferable that the elements of the fasteners which are attached to the element of clothing be of an iridescent color to provide notice when the case is not attached.

In a further preferred embodiment of the invention the element of clothing is a protective head gear, such as a helmet. The helmet is fitted with means for fastening at the least a first case, which is designed to carry face masks and earplugs. Preferably, a second case is provided for attachment to the helmet. The second case is designed to carry safety glasses. These cases are detachably mounted and held in position with fasteners. The fasteners are preferably selected from the group of fasteners comprising magnetic fasteners and hook and pile fasteners, such as Velcro® fasteners.

It is further preferred that the second shell lower surface be substantially flat when the case is designed for attachment onto the helmet and that the cases are contoured to smoothly meet the surface of the helmet.

It is also preferred that the elements of the fasteners attached to the helmet are an iridescent color, which makes the absence of the compartment readily apparent to an observer.

BRIEF DESCRIPTION OF THE DRAWINGS

FIG. 4 illustrates a hinge which spans the width of the case. Tabs on the shell rims facilitate the opening of the case. A snap clasp is also provided on the tabs to reduce the chance of accidental opening of the case.

BEST MODE FOR CARRYING THE INVENTION INTO PRACTICE

Figure 1:
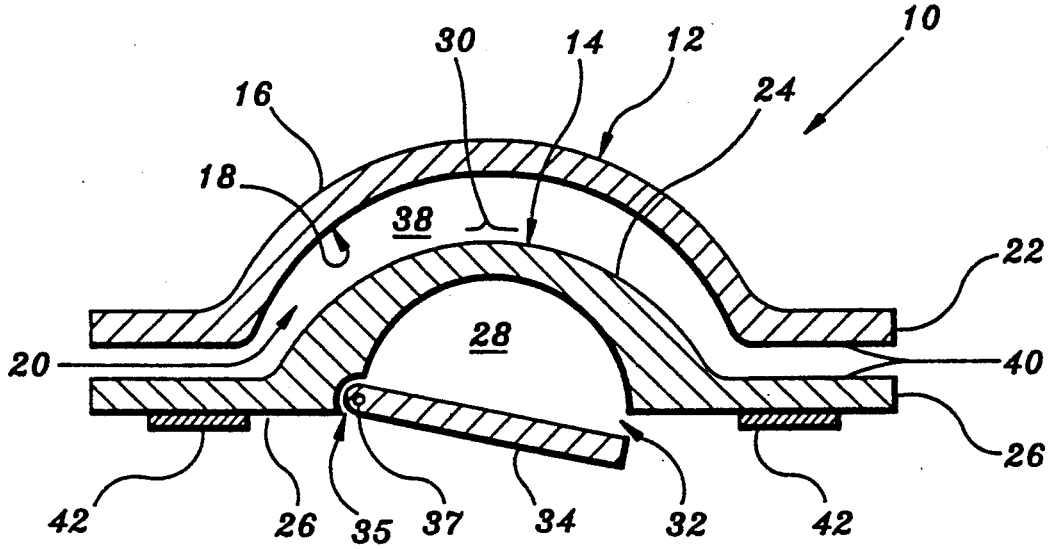
FIG. 1 is a schematic representation of one embodiment of the invention showing the spacial relationship between a first shell and a second shell. The embodiment of FIG. 1 has a compartment in the second shell having a passage providing access to the compartment. A compartment door is provided for opening and closing the passage. The door is located in the lower surface of the second shell to provide access to the compartment.

FIG. 1 illustrates one embodiment of a case 10 of the present invention. The case 10 has a first shell 12 and a second shell 14. The first shell 12 has a first shell upper surface 16 and a first shell lower surface 18. The first shell lower surface 18 is configured to provide a cavity 20 therein. The cavity 20 substantially conforms to the convex side of the dust masks (not shown) which are contained therein. A first shell rim 22 is attached to the first shell 12.

The second shell 14 has a second shell upper surface 24 and a second shell lower surface 26. A compartment 28 is contained in the second shell 14. The second shell upper surface 24 has a convex protrusion 30 thereon. The convex protrusion 30 is so configured to substantially conform to the shape of the cavity 20 in the first shell 12. A passage 32 provides access to the compartment 28. A compartment door 34 is attached to the second shell by a single axis hinge 35, with the door being rotatably attached to the hinge axis 37. The axis 37 is supported by the second shell 14. The door 34 is mounted so that it will close the passage 32 located in the second shell lower surface 26.

A second shell rim 36 is attached to the second shell 14. When the second shell rim 36 is in contact with the first shell rim 22, the first shell 12 and the second shell 14 are in close proximity, but remain spaced apart in the vicinity of the cavity 20 in the first shell lower surface 18. This spaced apart relationship creates a mask storage region 38 between the protrusion 30 and the first shell lower surface 18.

Means for attaching the first shell rim 22 to the second shell rim 36 are provided. As illustrated in FIG. 1, the means for attaching the first shell rim 22 and the second shell rim 36 are a mating adhering surfaces 40. These surfaces can be mating hook and pile surfaces, such as Velcro® fasteners, or magnetic surfaces.

Fastening means 42 are provided for fastening the case 10 to an element of clothing. For the embodiment of FIG. 1 the fastening means 42 are attached to the second shell rim 36. Preferred fastening means are hook and pile fasteners and magnetic fasteners.

Figure 2:
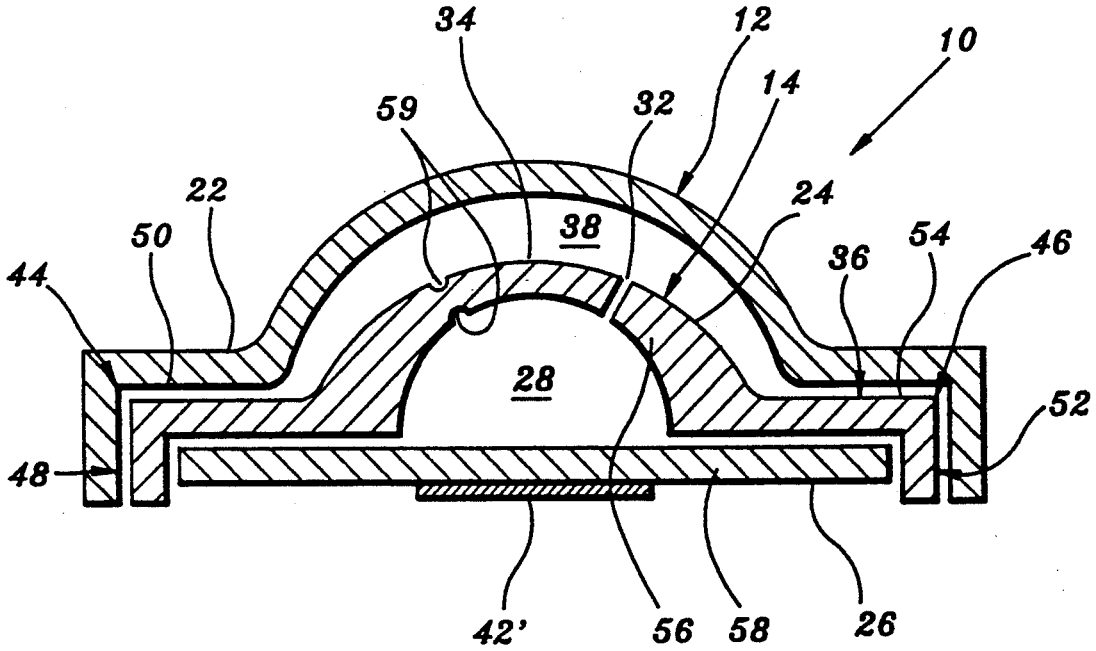
FIG. 2 is a schematic representation of another embodiment of the present invention similar to FIG. 1; however, the passage to the compartment is positioned on the protrusion which extends into the cavity within the lower surface of the first shell. The embodiment of FIG. 2 is fabricated from three pieces of sheet stock.

FIG. 2 illustrates another embodiment of a case 10 in which the compartment door 34 is located on the second shell upper surface 24 rather than on the second shell lower surface 26. The means for attaching the first shell rim 22 to the second shell rim 36 in the embodiment of FIG. 2 is a first rim corner 44 which engages a second rim corner 46.

The first rim corner 44 has a first corner sidewall 48 and a bottom ledge 50. The second rim corner 46 has a second corner sidewall 52 and a top ledge 54. These rim corners 44 and 46 provide the means for engaging the first shell rim 22 to the second shell rim 36. When the first shell rim 22 mates with the second shell rim 36 the first corner sidewall 48 slidably engages the second corner sidewall 52 and the bottom ledge 50 of the first rim corner 44 is in intimate contact with the top ledge 54 of the second rim corner 46. The sliding contact between the corner sidewalls 48 and 52 serve as means for attaching the first rim 22 to the second rim 36. This sliding contact of the sidewalls 48 and 52, as well as the intimate contact between ledges 50 and 54, provide a seal which protects the mask storage region 38 from dust or moisture.

The case 10 of FIG. 2 is constructed from sheet stock. The first shell 12 is constructed from a single piece of sheet stock while the second shell 14 is constructed from two pieces of sheet stock. The second shell 14 is formed by an upper sheet 56 and a lower sheet 58. The upper sheet 56 forms the second shell upper surface 24, while the lower sheet 58 forms the second shell lower surface 26; the compartment 28 lies between the upper sheet 56 and the lower sheet 58. The bottom sheet 58 is affixed to the second shell 14, preferably permanently by any standard techniques known in the art, such as gluing and thermally bonding.

The door 34 to the compartment 28, in this embodiment, is formed in the upper sheet 56 by cutting a door opening or passage 32 on three sides and allowing the fourth side to provide a hinge for the door 34. Notches 59, such as shown in FIG. 2, will facilitate bending.

The embodiment of FIG. 2 is further distinguished from the embodiment of FIG. 1 in that a single central fastening means 42' is employed, which is centrally positioned on the lower surface 26 of the second shell 14. Having the fastening a single central means 42' so positioned facilitates attachment to the clothing element without visual alignment. The central fastening means 42' should be so positioned with respect to the second shell rim 36 that attachment to the underlying clothing will not be impeded by the second shell rim 36.

Figure 3:
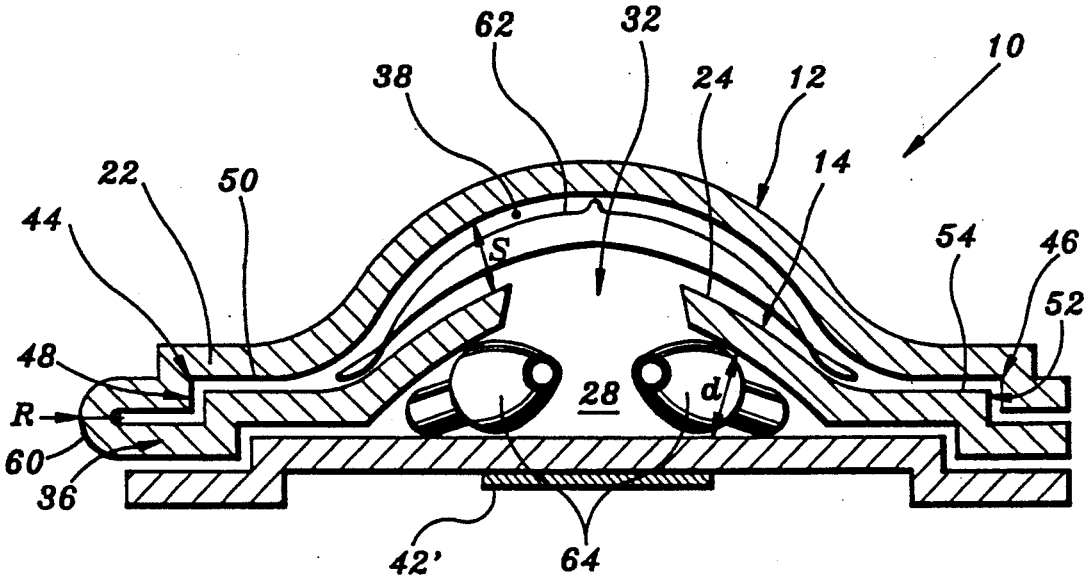
FIG. 3 is a schematic representation of another embodiment of the present invention wherein the rim of the first shell and the rim of the second shell are joined by a hinge. This embodiment does not employ a door for closing the passage to the compartment in the second shell.

FIG. 3 illustrates another preferred embodiment of a case 10 which is similar to the embodiment of FIG. 2; however, a hinge 60 is provided, which is attached to the first shell rim 22 and to the second shell rim 36 such that the first shell 12 will pivotably move with respect to the second shell 14. The two shells are held in the closed position by the friction between the sidewalls 52 and 48. The case 10 also differs from the case of FIG. 2 in that the passage 32 is not provided with a door such as the passage door 34 shown in FIG. 2.

In the embodiment illustrated in FIG. 3 the first shell 12 and the second shell upper surface 24 are fabricated from a continuous piece of plastic sheet stock. The hinge 60 between the first shell 12 and the second shell 14 is formed by crimping a sheet and pivotably connecting the first shell 12 and the second shell 14. The crimping should be such that an unstressed position of the crimped region results in the first rim 22 and the second rim 36 being substantially parallel and in close proximity. Having a generous radius R for the crimped region as illustrated, is further preferred in that it will allow flexing of the hinge with relatively low stress.

In this embodiment the passage 32, providing access to the compartment 28, is open. The contents of the compartment are maintained therein by the first shell 12 or, alternatively, by face masks 62 contained in the storage region 38 between the first shell 12 and the second shell 14. It is preferred that the separation s between the protrusion 30 and the first shell lower surface 18 be less than the minor dimension d of the earplugs 64 contained in the compartment 28. This separation will ensure that the earplugs 64 will remain in the compartment 28 when the case 10 is closed.

Again, in this embodiment rim corners 44 and 46 are employed for engaging the first shell rim 22 with the second shell rim 36. The first shell rim 22 is provided with a first rim corner 44 having a first corner sidewall 48 and a bottom ledge 50 and the second shell rim 36 is provided with a second rim corner 46 having a second corner sidewall 52 and a top ledge 54. The corners 44 and 46 are preferably configured such that the first corner sidewall 48 slidably engages the second corner sidewall 52.

Furthermore, the bottom ledge 50 of the first rim corner 44 is in intimate contact with the top ledge 54 of the second rim corner 46 when the shell rims 22 and 36 are engaged to provide the mask storage region 38. The contact between the corner sidewalls and ledges provides a seal between the first shell rim 22 and the second shell rim 36, thereby protecting the face masks being stored in the storage region 38 from dust and moisture.

Figure 4:
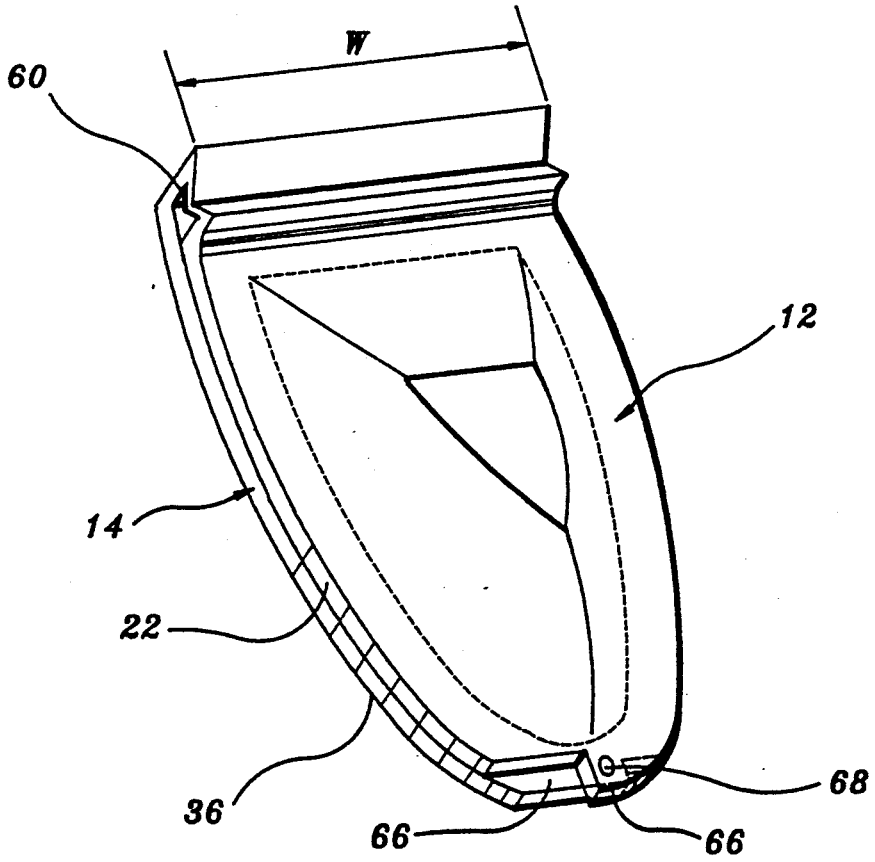
FIG. 4 is a perspective view of a preferred embodiment similar to the embodiment of FIG. 3.

FIG. 4 shows a perspective view of an embodiment similar to that of FIG. 3. In this embodiment tabs 66 are provided to assist in releasing the first shell 12 from the second shell 14. In this embodiment a hinge 60' is created by a double fold, proving a double V profile of the hinge. The double fold allows great flexibility in the joint, providing an accordion type action to provide greater freedom of movement between the rims 22 and 36. The flexibility and extendibility of the hinge element makes the engagement and disengagement of the rims 22 and 36 easier. It is further preferred that the hinge 60' spans the width w of the case 10, which will increase water resistance during exposure to rain when the hinge edge becomes the upper edge in inclement weather conditions. In this embodiment a lock 68 is also provided to further secure the first shell rim 22 with respect to the second shell rim 34. A snap or other standard fastener can be employed.

Figure 5:
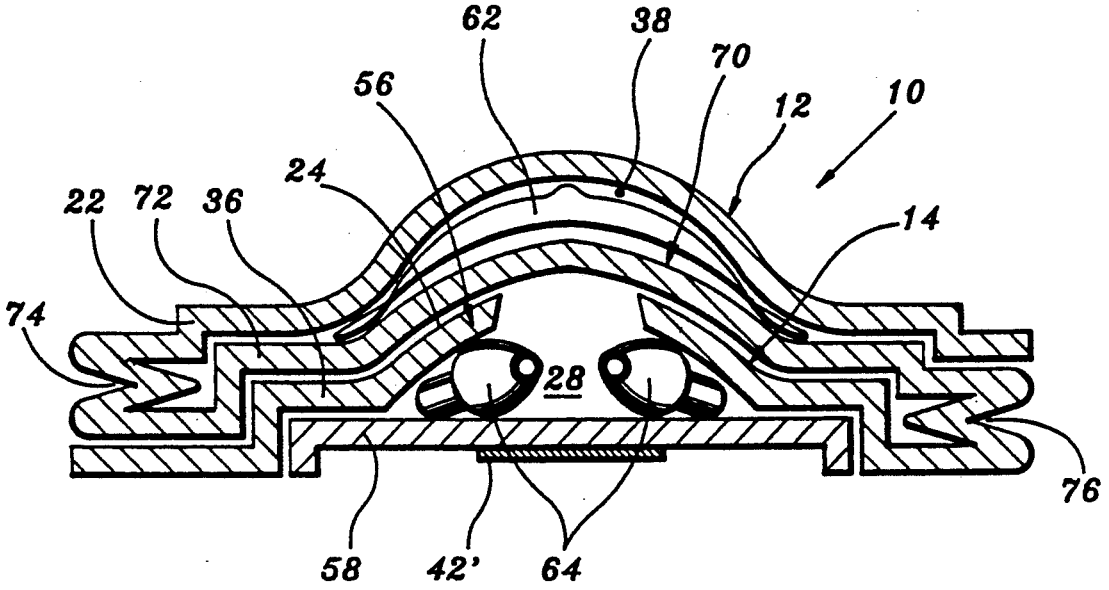
FIG. 5 is another embodiment of the present invention which employs an intermediate shell lying between the first shell and the second shell. In this embodiment the first shell, the upper surface of the second shell, and the intermediate shell are formed from a single sheet of plastic.

FIG. 5 illustrates another embodiment of a case 10 wherein an intermediate shell 70 is employed. The intermediate shell 70 lies between the first shell 12 and the second shell 14, substantially conforming to the second shell upper surface 24. An intermediate shell rim 72 is attached to the intermediate shell 70. The intermediate shell rim 72 engages the first shell rim 22 and the second shell rim 36. When the intermediate shell rim 72 is so engaged, the intermediate shell 70 serves to maintain the face masks 62 in position when the case 10 is opened to access earplugs 64 stored in the compartment 28. Similarly, the intermediate shell 70 serves to maintain the earplugs 64 in the compartment 28 when the case 10 is accessed for the masks 62 in the storage region 38. A continuous plastic sheet is used to form the first shell 12, a first flexible hinge 74, the intermediate shell 70, a second flexible hinge 76, and the second shell upper sheet 56. Flexible hinges 74 and 76, as shown in this embodiment, are double V hinges similar to the double V hinge of FIG. 4.

Figure 6:
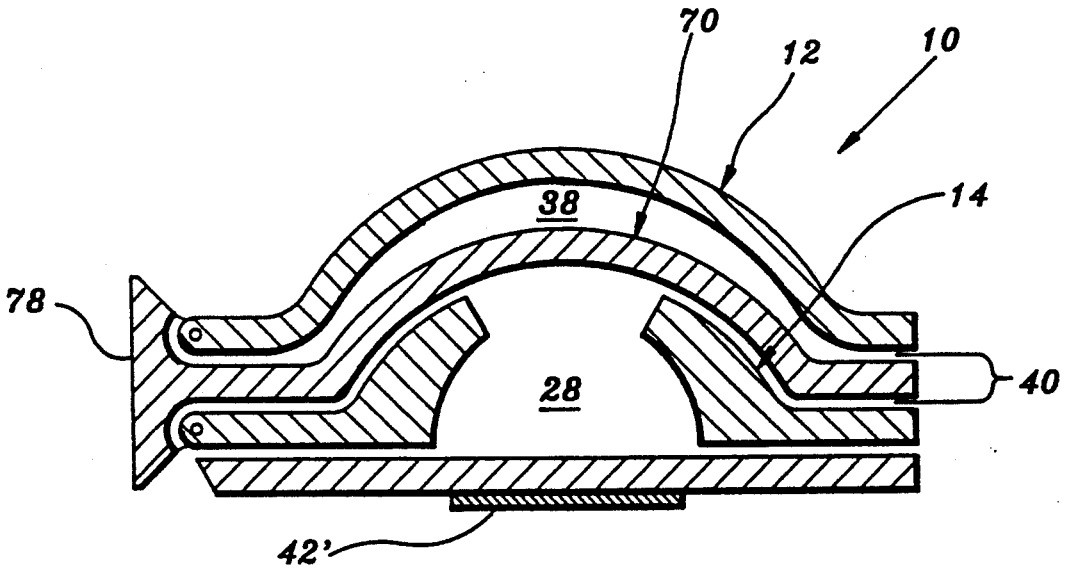
FIG. 6 is an embodiment similar to that of FIG. 5, wherein the shells are separate pieces and a dual hinge attached to the intermediate shell is employed, to pivotably mount the first and second shells.

FIG. 6 is an embodiment which is similar to the embodiment of FIG. 5 and has an intermediate shell 70. However, the embodiment illustrated in FIG. 6 differs from the embodiment of FIG. 5 in several respects. First, ridges are not employed as means for attaching the rims but, rather, mating adhering surfaces 40, such as hook and pile surfaces or magnetic surfaces are employed. Second, the three shells are connected by a pair of hinges having either a single axis or two substantially parallel axes in close proximity. As illustrated in FIG. 6, both shells 12 and 14 are joined by a dual axis hinge 78. The structure can be formed from three sheets of material which are joined by a dual axis hinge 78 attached to the intermediate shell 70. The dual axis hinge 78, when used for a case 10 to be attached to a helmet, will provide additional environmental protection against moisture when the dual axis hinge 78 is positioned in an upward position on a helmet. The dual axis hinge 78 provides a seal to resist penetration of the case 10 by falling rain.

Figure 7:
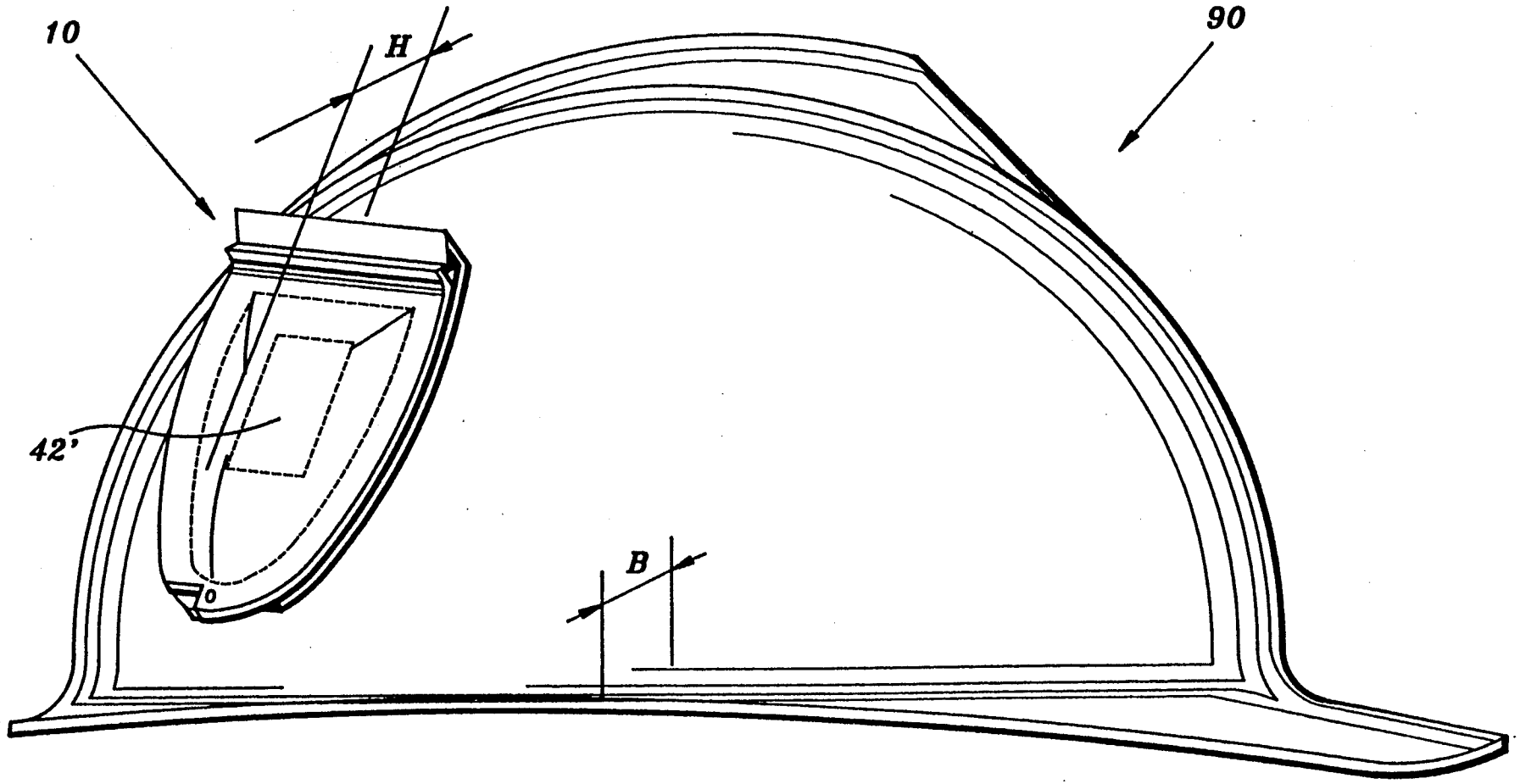
FIG. 7 is a side view of a helmet having attached thereto a case for storing face masks and earplugs.

FIG. 7 illustrates a side view of a helmet 90, which as illustrated is a hard hat which are helmets with brims and are worn by construction workers in the field. The helmet 90 has a detachably mounted face mask/earplug case 10 positioned thereon. The helmet 90 is employed as the element of clothing to which a mask/ear plug case 10, such as shown in FIGS. 1–6, is fastened. Preferably, the case 10 is configured with a maximum height H of the case 10, which is not more than 7 times the brim width B of the helmet 90. Maintaining this relationship ensures a small overhang of the case 10 beyond the footprint of the helmet 90. Minimizing the overhang will reduce the likelihood of the helmet 90 being knocked off while being worn.

It is further preferred that the position of the fastening means 42′ on the helmet 90 be so located that the attachment of the case 10 is in a rear quadrant of the helmet 90, so that direct contact with the case 10 is deflected by the helmet 90.

It is further preferred that, when the case 10 is to be connected to a helmet 90, the fastening means be centrally positioned on the second shell lower surface 26, as shown in FIGS. 2, 3, 5 and 6. Since the case 10 will be mounted on the back quadrant of the helmet 90 and out of sight of the wearer, having a central attachment will make the blind mounting of the case 10 on the helmet 90 easier.

It is also preferable that the element of the fastening means 42, which is attached to the clothing, is of an iridescent color. Having the element so colored will make it evident, even from a distance, that the case 10 is missing from the worker's attire. Again, having the fastening means 42 centrally located on the lower surface 26 of the second shell 14, as illustrated in FIG. 2, is preferred, since this will provide coverage of the iridescent colored fastening means 42 even when there is not complete registry between the two elements of the fastening means 42. The problem of exact registry becomes critical in the situation where the case 10 is being attached to a helmet 90, since the case 10 will be placed on the hard hat 90 without visual aid.

Figure 8:
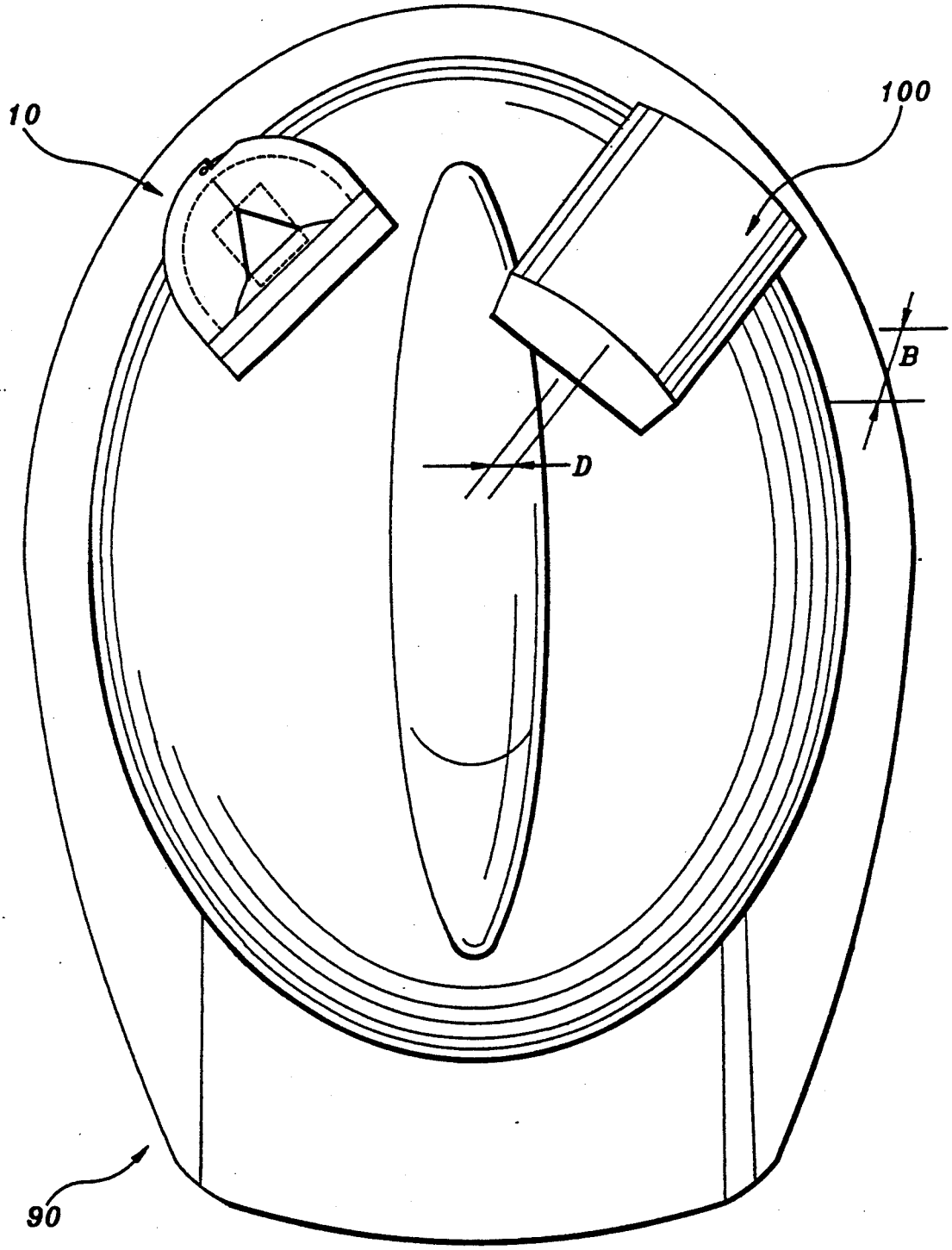
FIG. 8 is a top view of the helmet of FIG. 7 showing a preferred position for mounting the case for holding face masks and earplugs on the helmet. The helmet also has mounted thereon a second case which is designed to carry safety glasses.

FIG. 8 is a top view of the helmet 90 of FIG. 7 in which a glasses case 100 for safety glasses has been attached to the helmet 90, in addition to the face mask/earplug case 10. Again, it is preferable that the element of the fastening means 42 that is attached to the helmet 90 for each of the cases is of an iridescent color, making it evident, even from a distance, when the cases 10 and 100 are missing from the worker's attire. As with FIG. 7, it is preferred that width D of glasses case 100 is not more than 4 times the brim breadth B of helmet 90, to ensure a small overhang, reducing the likelihood of helmet 90 being knocked off while worn.

Figure 9:
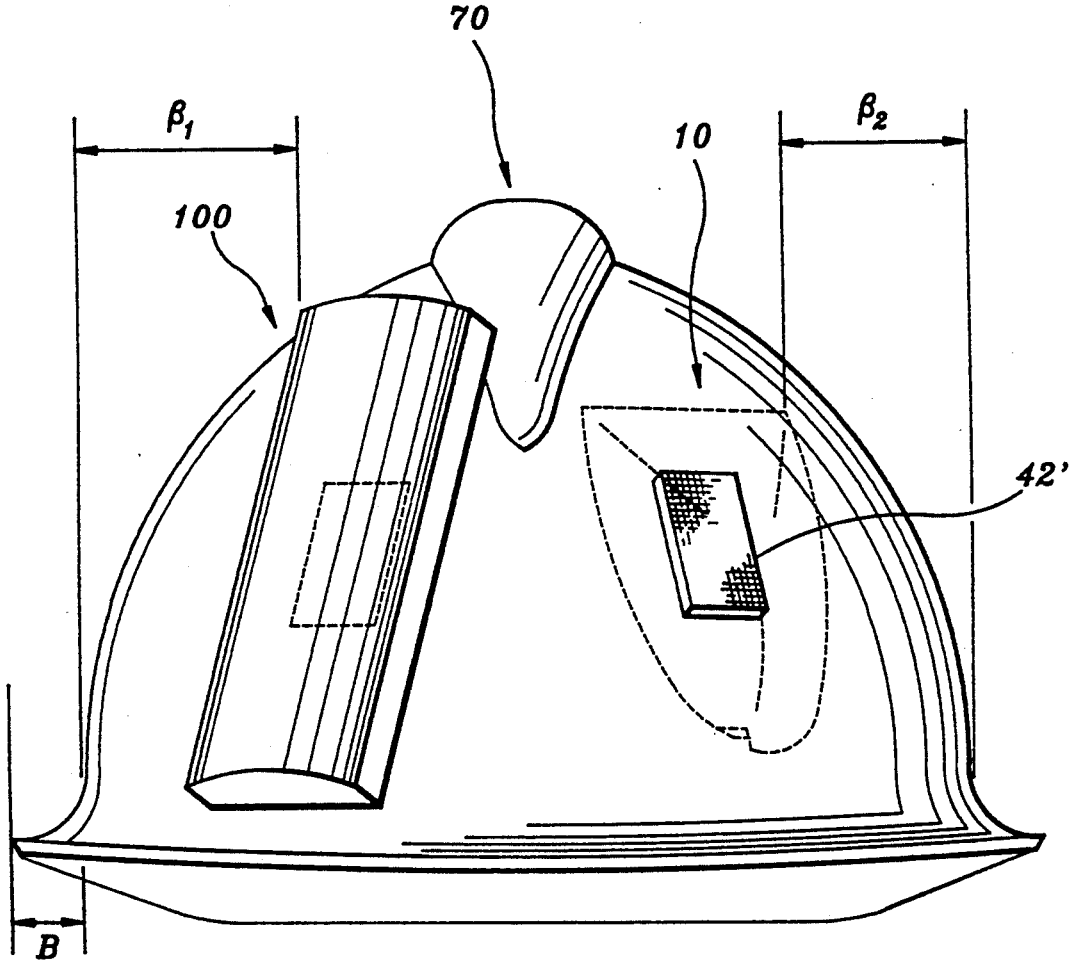
FIG. 9 is a back view of the helmet of FIG. 8, with the case for holding face masks and earplugs removed, exposing the fastening means for the case.

FIG. 9 is a back view showing the back profile of the embodiment of FIG. 8. The case 10 for face masks and earplugs is detached from the helmet, exposing the iridescent colored element of the fastening means 42. The position of the case is shown by the phantom lines.

FIG. 9 also illustrates the preferred location of the eyeglass case 100 and the case 10 for face masks and earplugs. The means for attaching the eyeglass case 100 and the case 10 for face masks and earplugs are so positioned on the helmet that the cases do not substantially extend beyond the profile of the helmet 90 as viewed from the rear. For the brimmed helmet or hard hat illustrated in FIG. 9, the containment of the structure substantially within the profile of the helmet will be met when the eyeglass case is maintained $\beta_1$ which is approximately twice the brim width B. This will maintain substantially all of the glasses case within the profile of the helmet 90. This condition will be met for the face mask/earplug case 10 when $\beta_2$ is greater than zero.

While the novel features of the present invention have been described in terms of particular embodiments and preferred applications, it should be apparent to one skilled in the art that substitution of materials and details obviously can be made without departing from the spirit of the invention.

What I claim is:

1. A case for carrying earplugs and face masks, the masks having a convex side and a concave side, the case being attachable to an element of clothing; the case comprising:

a first shell having a first shell upper surface and a first shell lower surface, said lower surface is configured to provide a cavity therein which substantially conforms to the convex side of the face mask;

a first shell rim attached to said first shell;

a second shell having a second shell upper surface and a second shell lower surface and a compartment therein, said second shell upper surface having a convex protrusion thereon, and said convex protrusion configured to substantially conform to said cavity in said first shell;

a passage in said second shell providing access to said compartment in said second shell;

a second shell rim attached to said second shell;

means for attaching said first shell rim to said second shell rim, said protrusion being so positioned on said second shell that said first shell bordering said cavity is in close proximity but spaced apart from said protrusion on said second shell when said first shell rim and said second shell rim are attached; and means for fastening the case to the element of clothing, said means for fastening the case, residing on said second shell lower surface.

2. The case of claim 1 further comprising:

hinge means pivotably attaching said first shell rim to said second shell rim.

3. The case of claim 2 wherein said means for attached said first shell rim to said second shell rim comprises:

a first rim groove having a first groove sidewall and a bottom ledge; and a second rim groove having a second groove sidewall and a top ledge, said first rim groove and said second rim groove being so configured that said first groove sidewall slidably engages said second groove sidewall and said bottom ledge is in intimate contact with said top ledge, thereby sealing said first rim to said second rim.

4. The case of claim 3 further comprising a door for closing said passage to said compartment.

5. The case of claim 3 further wherein said passage in said second shell is located in the upper surface of said second shell.

6. The case of claim 2 further wherein the means for fastening the case to the element of clothing is selected from the group consisting of a magnetic fastener and a hook and pile fastener.

7. The case of claim 1 further comprising:

an intermediate shell substantially conforming to said upper surface of said second shell;

an intermediate shell rim attached to said intermediate shell, said intermediate shell rim engaging said first shell rim and said second shell rim, so that the face masks may remain enclosed between the first shell and the intermediate shell when the case is opened to access said compartment.

8. The case of claim 1 wherein said first shell and said first shell rim form a first integral unit; and said second shell upper surface and said second shell rim form a second integral unit, said first and said second units each being formed from sheet stock.

9. The case of claim 8 further comprising a hinge means for pivotably attaching said first shell rim to said second shell rim and further wherein said hinge means is a crimped section of sheet attached to said first shell rim and to said second shell rim, and said first shell, said first shell rim, said second shell, said second shell rim, and said crimped section of sheet are formed from a single piece of sheet stock.

10. The case of claim 7 further comprising:

a first hinge pivotably attaching said first shell to said intermediate shell; and a second hinge pivotably attaching said second shell to said intermediate shell, further wherein said first hinge is a first crimped section of a sheet attached to said first shell rim and to said intermediate shell rim; and said second hinge is a second crimped section of sheet attached to said second shell rim and to said intermediate shell rim.

11. The case of claim 6 wherein said means for fastening the base to the element of clothing has a first surface which attaches to the clothing, and a second surface which attaches to the case, said first surface being iridescent.

12. A safety system comprising:

a helmet; and, a case for carrying earplugs and face masks, the masks having a convex side and a concave side, the case being attachable to said helmet; the case comprising:

a first shell having a first shell upper surface and a first shell lower surface, said lower surface is configured to provide a cavity therein which substantially conforms to the convex side of the face mask;

a first shell rim attached to said first shell;

a second shell having a second shell upper surface and a second shell lower surface and a compartment therein, said second shell upper surface having a convex protrusion thereon, and said convex protrusion configured to substantially conform to said cavity in said first shell;

a passage in said second shell providing access to said compartment in said second shell;

a second shell rim attached to said second shell;

means for attaching said first shell rim to said second shell 1m, said protrusion being so positioned on said second shell that said first shell bordering said cavity is in close proximity but spaced apart from said protrusion on said second shell when said first shell rim and said second shell rim are attached; and means for fastening the case to said helmet, said means for fastening the case being centrally located on said lower surface of said second shell and on a back quardrant of said helmet.

13. A safety system of claim 12 further wherein said means for fastening said case to said helmet is a set of mating surfaces with a first surface and said first surface being an iridescent color.

14. The safety system of claim 12 further comprising an eyeglass case configured to contain safety glasses and means for fastening said eyeglass case to said helmet.

15. The safety system of claim 14 wherein means for attaching said earplug and face mask case is a first set of mating adhesive surfaces with a first surface attachable to said helmet and said first surface being an iridescent color; and further wherein means for attaching said eyeglass case is a second set of mating surfaces with a first surface attachable to said helmet and said first surface being an iridescent color.

16. The safety system of claim 15 wherein said helmet is a safety hat having a brim with a predetermined width and further wherein said case for face mask and earplugs and said eyeglass case attaches to said hard hat, such that said case for face mask and earplugs and said eyeglass case does not extend beyond a back profile of said hard hat and that said eyeglass case is set back from the base of the back profile by at least twice said predetermined brim width B.

* * * * *